US006261441B1

(12) United States Patent
Gentry et al.

(10) Patent No.: US 6,261,441 B1
(45) Date of Patent: Jul. 17, 2001

(54) INTEGRATED HYDROPROCESSING SCHEME WITH SEGREGATED RECYCLE

(75) Inventors: Arthur R. Gentry, Houston, TX (US); Kenneth W. Goebel, Schnecksville, PA (US); Timothy L. Hilbert, Sewell, NJ (US); Michael G. Hunter, Katy, TX (US); David A. Pappal; Randall D. Partridge, both of Haddonfield, NJ (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/159,913

(22) Filed: Sep. 24, 1998

(51) Int. Cl.[7] ..... C10G 47/00

(52) U.S. Cl. ..... 208/58; 208/27; 208/28; 208/60; 208/58

(58) Field of Search ..... 208/27, 28, 60, 208/58, 59

(56) References Cited

U.S. PATENT DOCUMENTS 3,681,232 * 8/1972 Egan ..... 208/80
3,790,472 * 2/1974 White ..... 208/111
4,347,121 * 8/1982 Mayer et al. ..... 208/59
4,764,266 * 8/1988 Chen ..... 208/58
4,851,109 * 7/1989 Chen ..... 208/58
4,944,862 * 7/1990 Chen ..... 208/58
5,007,998 * 4/1991 Gruia ..... 208/59
5,275,719 * 1/1994 Baker, Jr. ..... 208/58
5,462,650 * 10/1995 Takito et al. ..... 208/27

* cited by examiner

*Primary Examiner*—Helane E. Myers
(74) *Attorney, Agent, or Firm*—Malcolm D. Keen

(57) ABSTRACT

This invention relates to the refining of petroleum products, and more particularly to an integrated hydroprocessing scheme involving a hydrocracking stage and subsequent dewaxing stage. Materials boiling in the middle distillate or lube oil range may be dewaxed. The bottoms streams (and optionally, other streams) of each stage are maintained separately from one another, during processing. Dewaxing may occur using either hydroisomerization catalysts or shape-selective catalysts or both in series. One embodiment employs a baffle in the flash zone of a fractionator to separate bottoms streams from each other. Alternatively, the effluent from the hydrocracking stage may be processed separately from the effluent from the dewaxing stage. The bottoms fraction from the dewaxing stage may be recycled back to the hydrocracking stage for further processing or used as lube base stock.

16 Claims, 3 Drawing Sheets

INTEGRATED HYDROPROCESSING SCHEME WITH SEGREGATED RECYCLE

CROSS REFERENCE TO OTHER APPLICATIONS

This application claims priority under 37 C.F.R. 1.78a(2) of application Ser. No. 08/578,295 now abandoned, filed Dec. 26, 1995, entitled Integrated Hydroprocessing Scheme with Segregated Recycle.

FIELD OF THE INVENTION

This invention relates to the refining of petroleum products, and more particularly to an integrated hydroprocessing scheme (involving hydrocracking and subsequent dewaxing by means of either shape selective or hydroisomerization catalysts) of materials boiling in the middle distillate and lube oil range in which the bottoms streams (and, optionally other streams) of each stage are maintained separately from one another during processing. The bottoms fraction from the dewaxing stage may be recycled back to the hydrocracking stage for further processing or used as lube base stock.

BACKGROUND OF THE INVENTION

Conventional petroleum hydrocracking and catalytic dewaxing are described by fundamentally different process chemistry. Due to their molecular structure, naphthenes and aromatics are easier to hydrocrack than paraffins. Less energy is required to open rings and saturate aromatics than is required to break paraffinic bonds. As a result, in conventional high conversion recycle hydrocracking, the recycle oil stream becomes rich in paraffins and is characterized by a very high pour point, which at time may exceed 38° C. (100° F.). "Shape selective" catalysts that restrict the cracking of ring structures and preferentially convert normal paraffins, resulting in substantial pour point and molecular weight reduction may be employed in catalytic dewaxing, particularly in the manufacture of lubricants. Specific types of dewaxing catalysts are designed to convert the normal paraffins by isomerization in conjunction with cracking and as a consequence are selective to middle distillate products such as kerosene and diesel oil.

The instant invention discloses an integrated hydroprocessing scheme which employs both hydrocracking and catalytic dewaxing. Unconverted hydrocracker bottoms are dewaxed in a dewaxing stage. Unconverted material from the dewaxing stage is subsequently recycled back to the hydrocracking stage. The feed to the catalytic dewaxing stage, the hydrocracked bottoms fraction, is generally rich in normal paraffins. These normal paraffins may be isomerized in the dewaxing stage to produce more branched chain paraffins which are suitable gasoline and middle distillate components.

The dewaxing stage may employ a single catalyst or a two catalyst system. A large pore catalyst such as zeolite B may be employed to isomerize n-paraffins or crack them to some extent depending on the catalyst activity. Shape selective, intermediate pore catalysts, such as ZSM-5, may also be used to crack n-paraffins.

Integrated hydroprocessing schemes which employ both hydrocracking and catalytic dewaxing steps are well known in the refining arts. U.S. Pat. No. 5,275,719 (Baker et al, hereinafter Baker) discloses a process for producing a high viscosity index lubricant which possesses a V.I. of at least 140 from a hydrocarbon feed of mineral oil origin which contains nitrogen compounds and has a wax content of at least 50 wt %. The feed is hydrocracked in an initial stage at a hydrogen partial pressure of at least 800 psig over a bifunctional lube hydrocracking catalyst comprising a metal hydrogenation component on an acidic, amorphous porous support material. Not more than 50 wt % of the feed is converted to products boiling outside the lube boiling range. The effluent of the first stage, which contains nitrogen compounds, is treated with a low acidity, isomerization catalyst having an alpha value of not more than 20, the catalyst comprising zeolite beta and a noble metal.

Waxy paraffins in the first stage effluent are thus isomerized to less waxy paraffins. Aromatics content is reduced to less than 1 wt %. Isomerization of waxy paraffins and hydrotreating occur simultaneously in the second stage of Baker. The temperature range required for simultaneous isomerization and hydrotreating is maintained by stripping gas and liquid compounds which contain nitrogen from the first stage effluent and returning such compounds as necessary to the second stage.

The overwhelming motivation of Baker is the maintenance of the lubricant VI by control of the conversion of the feed to lower boiling materials. Distillate production is only incidental in Baker. The process of the patent is actually directed to lubricant production. This is evident from the type of feedstocks used. The feedstocks employed in the instant invention typically contain no more than 30 wt % paraffins, whereas the feeds of Baker possess a wax content of at least 50 wt %. Presumably these waxes are paraffins. A preferred feed in Baker is slack wax, which typically possesses a nitrogen content of less than 30 ppmw, as illustrated by Tables 2 and 3 of Baker. The preferred feed in the instant invention is vacuum gas oil or light cycle oil. These feeds typically possess nitrogen contents greater than 300 ppmw and sometimes greater than 1000 ppmw, as the Tables 1-7 illustrate. Much of this nitrogen is found in the back ends of the aromatics, however.

Baker discloses only the use of amorphous hydrocracking catalysts in its process. The feeds of Baker, such as slack wax, contain nitrogen molecules which are easily removed by hydrocracking with an amorphous catalyst. Hydrocracking catalysts which comprise zeolites are not contemplated and would not be impractical for use in the Baker process, however. Hydrocracking catalyst comprising zeolites preferably ultrastable, large pore zeolites (such as REX, REY and USY are preferred in the instant invention because of their high cracking activity. Conversion to lower boiling products in the instant invention may be as great as 80 wt %, while in Baker, conversion is to be no more than 50 wt %. The feeds of the instant invention, such as vacuum gas oil, contain far greater amounts of total nitrogen than do the feeds of Baker. The nitrogen of VGO feeds, is however, more tightly bound because it is generally located in the heavy back ends of aromatics. It is less likely to contaminate the internal pores of a zeolite than are the loosely bound nitrogen molecules of a feed such as slack wax. As the pores of a zeolite become contaminated, conversion rates will decrease. More zeolite must be added to maintain the conversion level. A preliminary layer of hydrotreating catalyst might be necessary to treat the feed before it contacts the catalyst comprising the zeolite.

U.S. Pat. Nos. 4,764,266 (Chen et al. I) and 4,851,109 (Chen et al. II) disclose integrated hydroprocessing scheme in which high boiling feeds such as gas oil and catalytically cracked cycle oils are hydrocracked over aromatic selective hydrocracking catalysts, producing naphtha and middle distillate range products. In Chen et al. I, the preferred aromatic selective hydrocracking catalyst comprises USY. Unconverted material may be recycled to the hydrocracking stage or may be passed to the dewaxing stage, where it is treated with a large pore catalyst, specifically zeolite beta, which has a hydrogenation-dehydrogenation functionality, in order to produce more kerosene and distillate range products. Although recycle of hydrocracker bottoms is employed in these patents, unconverted material from the dewaxing stage is not recycled to the hydrocracker. Furthermore, these processes do not illustrate the use of an atmospheric distillation tower having a baffle in the flash zone in order to separate the bottoms material from two different process streams, as illustrated in one embodiment of the instant invention.

PCT application WO 95/10578 discloses a process for the production of middle distillate products by the dewaxing of hydrocarbonaceous material boiling above 343° C. The feed is hydrocracked with a catalyst comprising a large pore zeolite such as Y and a hydrogenation metal component selected from Group VIB or Group VIII. The entire effluent of the hydrocracking zone is then dewaxed in the presence of hydrogen with a catalyst comprising an intermediate pore zeolite of the ZSM-5 type. In the instant invention, only the bottoms of the hydrocracker effluent is dewaxed.

European Patent 189648 A1 discloses a process for the hydroprocessing of heavy gas oil feeds in order to maximize kerosene and distillate production. FIG. 5 of this patent illustrates hydrocracking of the feed, followed by catalytic dewaxing. All of the effluent of the hydrocracking unit is dewaxed in this invention, not just the bottoms, as in the instant application. Furthermore, there is no teaching of recycling to the initial hydrocracking stage. Two different hydrocracking stages are used.

U.S. Pat. No. 5,053,117 (Kyan et al) discloses a process for dewaxing hydrocracker bottoms from the MPHC (Moderate Pressure Hydrocracker Bottoms) process to produce either naphtha and gas oil under MDDW conditions or lubricants under the less severe conditions of MLDW. The feed to the dewaxing unit may be combined with gas oil of high nitrogen content, thereby improving the octane number of the naphtha product. There is no teaching of the recycling of dewaxer bottoms to the hydrocracker. Gasoline octane number may be improved by maximizing olefin production. This may be accomplished by employing MDDW catalyst and conditions with minimal hydrogenation.

A variety of patents illustrate a generalized process scheme in which a feed such as a heavy gas oil (or other hydrocarbon feed boiling above 343° C. (650° F.)) is hydrocracked, then dewaxed to produce lubricating oils. U.S. Pat. No. 4,414,097 (Chester et al) discloses a process in which a hydrocarbon feedstock which boils above 343° C. (650° F.) is hydrocracked, then dewaxed over a catalyst comprising ZSM-23.

U.S. Pat. Nos. 4,282,271 (Garwood et al) and 4,283,272 (Garwood et al) disclose hydroprocessing of lubricating oils by hydrocracking of feedstocks boiling above 343° C. (650° F.). The hydrocrackate is subsequently dewaxed. The effluent from the dewaxer is hydrotreated but is not recycled to the hydrocracking stage.

SUMMARY OF THE INVENTION

This invention relates to the refining of petroleum products, and more particularly to an integrated hydroprocessing scheme (involving a hydrocracking stage and subsequent stage in which unconverted hydrocracker bottoms are subsequently dewaxed). The bottoms streams (and optionally, other streams of each stage) are maintained separately from each other. Dewaxing may occur using either hydroisomerization catalysts, or shape-selective catalysts or both in series. One embodiment employs a baffle in the flash zone of a fractionator to separate bottoms streams from each other. Alternately, the effluent from the hydrocracking stage may be processed separately from the effluent from the dewaxing stage. The bottoms fraction from the dewaxing stage may be recycled back to the hydrocracking stage for further processing or used as lube base stock.

The integrated hydroprocessing scheme of the instant invention is capable, by means of its recycling step, of achieving maximum yields at minimum costs. The process is flexible, permitting dewaxing to be performed at the same pressure as the hydrocracking step (high pressure dewaxing) or at substantially lower pressure, resulting in conversion with reduced hydrogen consumption. Furthermore, products may be taken from a single fractionation unit or from more than one fractionation unit. In this way, products obtained following dewaxing may be segregated from products which were obtained following the hydrocracking stage. Although common product recovery may be employed with a single fractionation unit, it is still desirable to maintain separation of the unconverted bottoms products from the two reaction stages, since at least a portion of the dewaxed effluent may be recycled to the hydrocracker. In one embodiment, reactor products from the hydrocracking stage and the dewaxing stage may be separately stripped. The combined strip-out stream is then debutanized. LPG is recovered at minimum cost. The reactor liquid product streams are separately changed to the fractionator (see FIGS. 1 and 3).

In another embodiment a make-up compressor may be used to supply once-through hydrogen flow between compression stages. The dewaxing stage may be operated at reduced pressure and low gas to oil ratio. Dewaxer outlet hydrogen is then compressed into the hydrocracker stage for make-up, eliminating the need for separate recycle hydrogen compression facilities in the dewaxing stage (FIG. 3).

The dewaxing by isomerization of materials boiling in the middle distillate range improves cold flow properties of products, such as diesel pour point, cloud point, and jet fuel freeze point. The paraffinicity of the kerosene and diesel products is improved in the instant invention, thereby improving the burning quality of the middle distillates.

BRIEF DESCRIPTION OF THE DRAWINGS

FIGS. 1 and 3 illustrate separate stripping of the reactor products from the two stages. The combined strip-out stream is then debutanized. FIG. 3 illustrates both hydrocracking and dewaxing stages operating at the same pressure level.

DETAILED DESCRIPTION OF THE INVENTION

Feed

Figure 1:
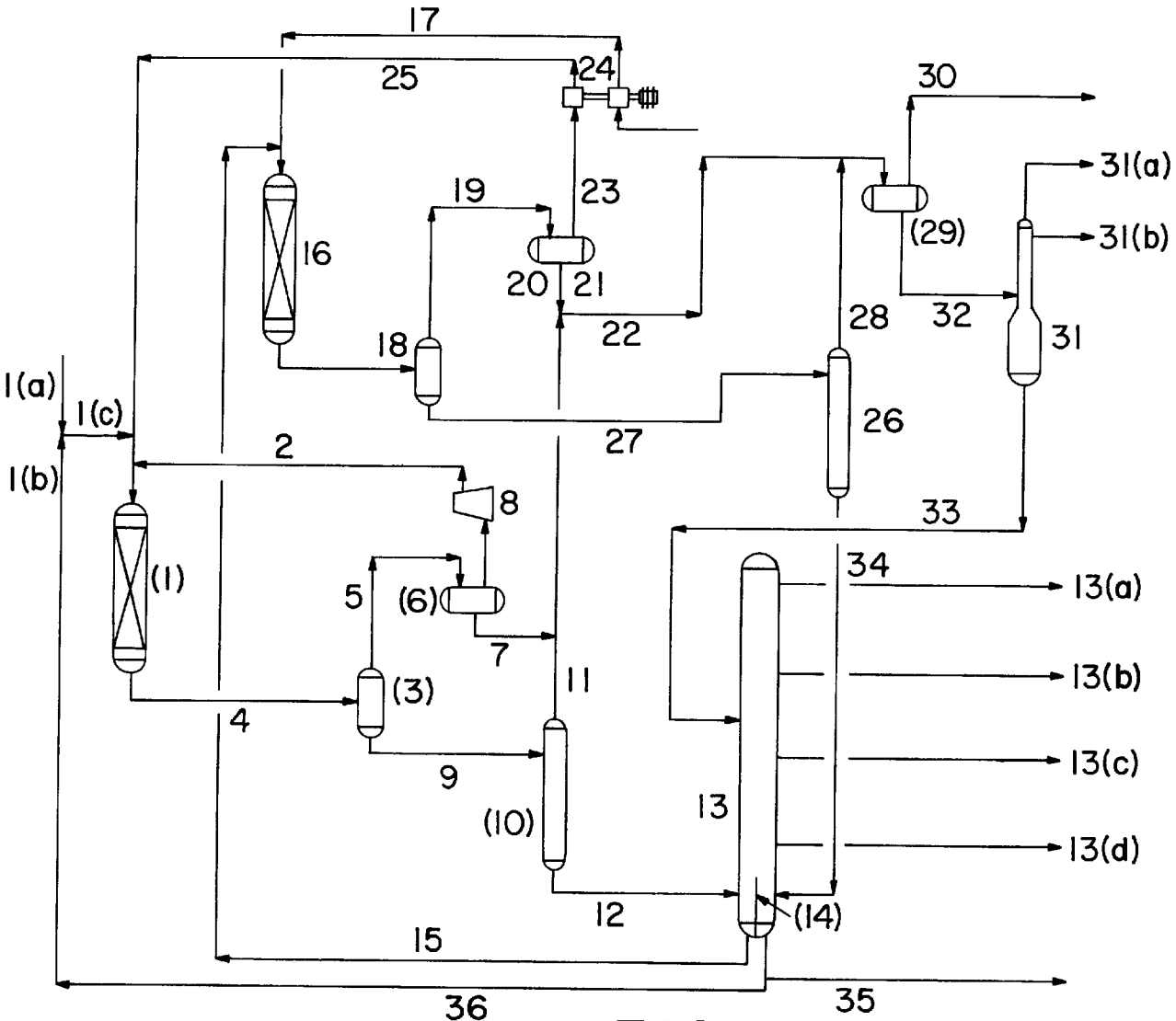
FIG. 1 illustrates the integrated hydrocracking and dewaxing steps of this invention. Although not illustrated, the hydrocracking stage may also encompass a dual hydrotreating hydrocracker catalyst system. Following hydrocracking, the feed is separated into products in the fractionation unit by atmospheric distillation. The bottoms materials of the hydrocracking stage are subsequently dewaxed. The fractionation unit of FIG. 1 illustrates a baffle in the flash zone in order to maintain separately the bottoms fractions from the hydrocracking stage and the dewaxing stage.

The feedstocks which are employed in the present process may be generally characterized as high boiling point feeds of petroleum origin although feeds of other origin may also be employed, for example, feeds from synthetic oil production processes such as Fischer-Tropsch synthesis or other synthetic processes, e.g. methanol conversion processes. Fractions from unconventional sources such as shale oil and tar sands may also be processed by the present integrated hydroprocessing technique. In general, the feeds will have a relatively high boiling point, usually above about 205° C. (about 400° F.) or higher, for example, above 230° C. (about 450° F.) and in most cases, above about 315° C. (about 600° F.), with many having an initial boiling point of above about 345° C. (about 650° F.). The boiling characteristics, especially the end point, of the feed will be determined by the products required. If lubricants are to be produced in significant quantity, the feed must itself contain significant quantities of components in the lubricant boiling range, usually above 345° C. (about 650° F.). Thus, when lubricant production is desired, the feed will generally be a gas oil, i.e. a high boiling distillate feed with an end point typically below 565° C. (about 1050° F.) although significant quantities of nondistillable residues are not to be excluded in the feeds which may be processed. Deasphalted oil (oil obtained from the propane deasphalting unit and suitable for the production of brightstock, may also be used as feed. Typical feeds which may be processed include gas oils such as coker heavy gas oil, vacuum gas oils, reduced crudes and atmospheric gas oils. By contrast, when the process is to be employed principally for producing middle distillate and naphtha, especially jet fuel, the feed may have a relatively lower end point since there is no need to conserve higher boiling components. Thus, for jet fuel production, catalytic cracking cycle oils including light cycle oil (LCO) and heavy cycle oil (HCO), clarified slurry oil (CSO) and other catalytically cracked products are an especially useful source of feeds for the present process. Cycle oils from catalytic cracking processes typically have a boiling range of about 205° to 400° C. (about 400° to 750° F.) although light cycle oils may have a lower end point e.g. 315° C. or 345° C. (about 600° or 650° F.). Heavy cycle oils may have a higher initial boiling point (IBP) e.g. about 260° C. (about 500° F.). The relatively high aromatic content of the cycle oils renders them extremely suitable for processing in the initial hydrocracking step of the present integrated process sequence and, in addition, the decreasing level of demand for such refractory stocks at the present makes them extremely attractive materials for processing in the present scheme.

Because of their high boiling point, the feeds for use in the present process generally contain relatively high proportions of aromatics, especially of polycyclic aromatics although significant quantities of high boiling paraffins and cycloparaffins are also present. If the feed has been subjected to catalytic cracking, the aromatics will be substantially dealkylated and resistant to further cracking except in a hydrogenative process such as the present one. The present process is notable for its ability to convert refractory aromatic feeds such as those obtained from catalytic cracking operations to high quality, highly paraffinic distillate products of low pour point as well as low pour point lubricants.

As a generalization, the aromatic content of the feeds used in the present process will be at least 30, usually at least 40 weight percent and in many cases at least 50 weight percent. The balance will be divided among paraffins and naphthenes according to the origin of the feed and its previous processing. The feedstock employed in the instant invention typically contain no more than 30% wt. paraffins, as Tables 1-7 illustrate. Nitrogen content of the feeds tacks is typically at least 300 ppmw, and at times greater than 1000 ppmw. Catalytically cracked stocks will tend to have higher aromatic contents than other feeds and in some cases, the aromatic content may exceed 60 weight percent. be hydrotreated in order to remove contaminants prior to hydrocracking.

Typical vacuum gas oil (VGO) compositions are shown in Tables 1-3, including a hydrotreated (HDT) gas oils in Tables 2, together with two typical FCC LCO feeds in Tables 4 and 5.

TABLE 1

| VGO Properties in General | |
|---|---|
| API Gravity | 23.2 |
| Distillation, et. pct. | |
| 225°–345° C. (440°–650° F.) | 7.0 |
| 345–400° C. (650°–750° F.) | 17.0 |
| 400° C.+ (750° F.+) | 76.0 |
| Sulfur, wt. pct. | 2.28 |
| Nitrogen, ppmw. | 550 |
| Pour Point, ° C. (° F.) | 18 (95) |
| KV at 100° C., cSt. | 5.6 |
| P/N/A, wt. pct. | 29/21/50 |

TABLE 2

| HDT Statfjord VGO | |
|---|---|
| Nominal boiling range, ° C. (° F.) | 345–455 (650–850) |
| API Gravity | 31.0 |
| H, wt. pct. | 13.76 |
| S, wt. pct. | 0.012 |
| N, ppmw | 34 |
| Pour Point, ° C. (° F.) | 32 (90) |
| KV at 100° C., cst | 4.139 |
| P/N/A wt. % | 30/42/28 |

TABLE 3

| Arab Light HVGO | |
|---|---|
| API Gravity | 22.2 |
| Hydrogen, wt. pct | 12.07 |
| Sulfur, wt. pct | 2.45 |
| Nitrogen, ppmw | 600 |
| CCR, wt. pct | 0.4 |
| P/N/A, wt. pct | 24/25.3/50.7 |
| Pour Point, ° C. (° F.) | 40 (105) |
| KV at 100° C., cSt | 7.0 |
| Distillation (D-1160) pct. | |
| IBP | 345 (649) |
| 5 | 358 (676) |
| 10 | 367 (693) |
| 50 | 436 (817) |
| 90 | 532 (989) |
| 95 | 552 (1026) |
| FBP | 579 (1075) |

TABLE 4

| FCC LCO Properties | |
|---|---|
| API Gravity | 21.0 |
| TBP, 95%, ° C. (° F.) | 362 (683) |
| Hydrogen, wt. pct. | 10.48 |
| Sulfur, et. pct. | 1.3 |
| Nitrogen, ppmw | 320 |
| Pour Point ° C. (° F.) | −15 (5 ) |

TABLE 4-continued

| FCC LCO Properties | |
|---|---|
| KV at 100° C. (° F.) | — |
| P/N/A, wt. pct. | — |

TABLE 5

| FCC LCO Properties | |
|---|---|
| Distillation, wt. pct. | |
| 215° C.– (420° F.–) | 4.8 |
| 215–345° C. (420°–650° F.) | 87.9 |
| 345–425° C. (650°–800° F.) | 7.3 |
| 425–540° C. (800°–1000° F.) | — |
| 540° C.+ (1000° F.+) | — |
| H, wt. pct | 10.64 |
| S, wt. pct. | 1.01 |
| N, wt. pct. | 0.24 |
| Ni + V, ppmw | — |
| CCR, wt. pct. | — |
| HC Type, wt. pct. | |
| Paraffins et. pct. | 12.7 |
| Mononaphthenes | 11.7 |
| Polynaphthenes | 12.8 |
| Monoaromatics | 24.7 |
| Diaromatics | 21.7 |
| Polyaromatics | 14.3 |
| Aromatic sulfur type | 2.1 |
| P/N/A | 12.7/24.5/62.8 |

TABLE 6

| CHIBA VGO FEED PROPERTIES | | | |
|---|---|---|---|
| Elemental Analysis | | Boiling Point, ° F. | |
| Sulfur | 1.55 wt. % | IBP 569 | |
| Nitrogen | | | |
| (Total) | 620 ppm | T(10) 667 | |
| (Basic) | 179 ppm | T(50) 812 | |
| Hydrogen | 12.36 wt. % | T(90) 1010 | |
| Carbon Residue (CCR) | 0.82 wt. % | EP 1021 | |
| | | Residue | 8.5 wt. % |
| Physical Properties | | Composition, wt. % | |
| Density | 0.87 g/cc | Paraffins | 57.6 |
| Pour Point | 120° F. | Aromatics | 41.9 |
| API | 24.7 | | |
| Viscosity @ 100° C. | 5.84 cS | | |

Catalyst and Conditions

Initial Hydrocracking Stage

The objective of the hydrocracking which is carried out in the initial stage of the integrated hydroprocessing scheme is to provide a feed with a relatively high concentration of paraffins for processing in the second stage over the catalyst or shape selective dewaxing catalyst. Accordingly, the catalyst which is used in the first stage hydrocracking is a catalyst which is selective for the aromatics in preference to the paraffins although hydrocracking of the paraffins is not precluded. Conventional hydrocracking catalysts are therefore employed in this stage, using a large pore size solid with acidic functionality coupled with a hydrogenation function. The use of the large pore size material is considered essential for hydroprocessing of high boiling feeds such as gas oils in order that the bulky, polycyclic aromatic components in the feed may obtain access to the internal pore structure of the catalyst where the characteristic cracking reactions principally occur. A limited degree of cracking will occur on the external surfaces of the catalyst particle but the major part of the surface area of the catalyst is within the particles. It is essential that the components of the feed which are to undergo cracking have access to this internal pore structure. Accordingly, the acidic functionality in the first stage hydrocracking catalyst is provided by a large pore size crystalline material, preferably a large pore size aluminosilicate zeolite such as zeolite X, zeolite Y, ZSM-3, ZSM-18, ZSM-20, MCM-22 or zeolite beta. The zeolites may be used in various cationic and other forms, preferably forms of higher stability so as to resist degradation and consequent loss of acidic functionality under the influence of the hydrothermal conditions encountered during the hydrocracking. Thus, forms, of enhanced stability such as the rare earth exchange large pore zeolites, e.g., REX and REY are preferred, as well as the so-called ultra stable zeolite Y (USY) and high silica zeolites such as dealuminized Y or dealuminized mordenite, then zeolites having silica/alumina ratio of at least 50%. Particularly preferred in the instant invention is dealuminized USY catalyst.

Zeolite ZSM-3 is disclosed in U.S. Pat. No. 3,415,736, zeolite ZSM-18 in U.S. Pat. No. 3,950,496 and zeolite ZSM-20 in U.S. Pat. No. 3,972,983, to which reference is made for a description of these zeolites, their properties and preparations.

Crystalline components may be incorporated into an amorphous matrix for greater physical strength and the matrix itself may be catalytically active. For example, it may be an amorphous alumina or silica-alumina or a clay with acidic functionality so that it participates in the acid-catalyzed cracking reactions which take place. Typically, the matrix will constitute about 40-80 weight percent of the catalyst, and more commonly 50-75 weight percent.

The hydrogenation function may be provided in the conventional way by use of a base or noble transition metal component, typically from Groups VIA and VIIIA of the Periodic Table. Such metals include nickel, cobalt, tungsten, molybdenum, palladium or platinum with the base metals nickel, tungsten, cobalt and molybdenum being preferred. Combinations such as nickel-tungsten, nickel-cobalt and cobalt-molybdenum being especially useful, particularly with feeds with a selectively high level of contaminants.

By operating with an aromatic-selective, naphtha directing catalyst under conditions of low to moderate severity, a major proportion of naphtha product boiling below about 165° C. (330° F.) may be produced, containing a relatively high quantity of naphthenes which render it valuable for reforming to make high octane gasoline. In addition, a small to moderate quantity of middle distillate is produced together with a high boiling fraction.

If the hydrocracking stage is operated in a distillate selective mode under conditions of low to moderate severity with low to moderate hydrogen pressures, for example, as described in U.S. Pat. No. 4,435,275, the converted fraction will comprise a major proportion of middle distillates, typically boiling in the 165° to 345° C. (about 330° to 650° F.) with lesser proportions of naphtha. Middle distillates will also be predominate in the product if a distillate selective catalyst is employed, as disclosed in U.S. Pat. No. 4,820,402. The middle distillate fraction can be quite aromatic in character if operated at relatively low pressures. Aromatics content in the product is generally reduced if higher pressures are employed. If highly aromatics, the middle distillate fraction is generally unsuitable for use directly as jet fuel or diesel but may be used as a blending component for diesel fuels if combined with other, more highly paraffinic components. It may also be used for fuel oils either as such or blended in with other, higher boiling components. This middle distillate fraction is, however, relatively low in sulfur and generally meets product specifications for use as a light fuel oil, e.g. home heating oil. The unconverted fraction, or bottoms fraction from the low-to-moderate pressure first stage hydrocracking is typically waxy and very low in sulfur and nitrogen. Although this product has value and may be sold as low sulfur heavy fuel oil, treatment of it in the isomerization or dewaxing stage results in a significant increase in distillate yield and quality. The paraffins which remain in the hydrocracker bottoms, are selectively converted in the second stage to lower boiling products with a high content of isoparaffins.

When the hydrocracking step is operated in the naphtha selective mode, conditions of moderate to high severity will be employed. Thus, a relatively acidic hydrocracking catalyst or a hydrotreating/hydrocracking catalyst combination with a naphtha directing tendency will be used at relatively high temperatures towards the upper end of the hydrocracking range, e.g. 400°-450° C. (about 750°-850° F.). Temperatures of this magnitude may readily be attained by control of the hydrogen quench in the reactor, although severity may also be controlled by appropriate regulation of the space velocities. In order to promote saturation of the aromatics in the feed, high hydrogen partial pressures will be preferred, typically above about 7,000 kPa (about 1,000 psig) and often above about 10,000 kPa (about 1,435 psig) will be typical and preferred for naphtha mode operation. Space velocity (LHSV) will usually be below about 2 $hr^{-1}$ with values below 1 $hr^{-1}$ if lower operating temperatures are desired. Hydrogen circulation rate will be selected to maintain catalyst activity at the selected temperature and will typically be at least 350 $n.l.l.^{-1}$ (about 1966 SCF/Bbl) and in most cases from 500 to 1,000 n.l.l. (about 2810 to 5620 SCF/Bbl). The naphtha-selective hydrocracking step is very effective at reducing the level of sulfur and nitrogen in the unconverted bottoms fraction so that it is characterized by a low level of sulfur and nitrogen as well as a high level of waxy paraffins. These paraffins are then selectively isomerized and hydrocracked by the second stage operation to produce the high quality distillate and kerosene products.

The changes in product distribution which take place when naphtha-selective hydrocracking is used in the first stage can be stated as follows: the feed, comprising paraffins, naphthenes and aromatics is converted to a full range product with a naphtha of pronounced naphthenic/aromatic character. The aromatics in the feed are reduced by the aromatic selective characteristics of the first stage catalyst. When the paraffinic bottoms fraction is subjected to the second stage hydroprocessing over the zeolite beta based catalyst, the paraffins are preferentially converted to low pour point iso-paraffins in the middle distillate boiling range while minor quantities of naphtha are produced. The unconverted fraction is a low pour product by reason of the isomerization of the paraffins in it to iso-paraffins.

Operation in the naphtha mode is favored by the use of more highly acidic catalysts, higher severity and higher hydrogen pressures, although as in all refining processes the exact conditions to be employed will be selected according to the characteristics of the feed. A single hydrocracking catalyst may be employed or a hydrotreating hydrocracking catalyst system. In achieving the desired moderate to high severity conditions appropriate for naphtha production, temperature and space velocity (LHSV) interact so that lower temperatures may be used at lower space velocities. Thus, temperatures as low as about 250° C. (about 480° F.) may be employed although higher temperatures, typically above about 315° C. (about 600° F.) will be more common. If a hydrotreating/hydrocracking system is employed, operating temperatures will range between 650-700° F. The upper temperature limit will normally be about 450° C. (about 850° F.) and temperatures of 400-450° C. (750°-850° F.) will provide appropriate levels of severity at a higher space velocities which permit greater throughput albeit at the expense of accelerated catalyst aging. Space velocity (LHSV) is usually below 2 $hr^{-1}$ with values below 1 $hr^{-1}$ at the lower temperature below about 315° C. (about 600° F.). Operation in the naphtha mode is also favored by the use of higher hydrogen partial pressures to promote aromatics saturation followed by ring opening and cracking to naphtha. Hydrogen partial pressures of at least 7,000 kPa (about 1,000 psig), preferably at least 10,000 kPa (about 1,435 psig) are therefore preferred. Higher pressures of 15,000 kPa (about 2,160 psig) favor aromatics saturation greatly, although at the expense of increased hydrogen consumption. Hydrogen circulation rate is typically at least 300 $n.l.l.^{-1}$ (at least about 1,685 SCF/Bbl), preferably at least 500 $n.l.l.^{-1}$ (about 2,800 SCF/Bbl) and normally in the range 500-1,000 $n.l.l.^{-1}$ (about 2,800-5,600 SCF/Bbl). Conversion per pass to naphtha and lower boiling products (165° C.–) will depend on feed properties and conditions but will generally be in the range 5-25 wt. percent; total bulk conversion per pass (i.e. conversion to lower boiling products) will generally range from 15-80 wt. percent, in most cases 20-60 wt. percent.

It is desirable to maximize the naphthene/aromatic character of naphtha so that it will then be more amenable to reforming. The bottoms product from the naphtha-selective hydrocracking step is concentrated in paraffins (relative to the feed) because the catalyst used in this step attack the aromatics in preference to the paraffins. Processing of the paraffin rich bottoms fraction in the subsequent dewaxing step using hydroisomerization catalyst then results in higher total yields of iso-paraffinic liquid products such as jet fuel and low pour point distillate. The bottoms faction of the hydroisomerization step is relatively richer in naphthenes and aromatics and is recycled back to the hydrocracker. This results in a higher naphtha yield and a naphtha with a greater naphthenic/aromatic character than operation with no recycle or recycle of hydrocracker bottoms.

Operation of the hydrocracking in a distillate directing mode generally implies lower severity with the use of a less acidic catalyst. Again, temperature in the range of 250°-450° C. (480-850° F.) may be used although higher space velocities of up to 2 $hr^{-1}$ may be appropriate to obtain the desired severity. If an aromatic distillate product is acceptable, low hydrogen partial pressures may be employed as in the hydrocracking process described in U.S. Pat. No. 4,435,275, to which reference is made for a description of preferred operating conditions in a distillate directing mode. As described there, hydrogen pressures of 5,250 to 7,000 kPa (about 745 to 1,000 psig) are satisfactory with hydrogen circulation rates of 250 to 1,000 $n.l.l.^{-1}$ (about 1,400 to 5,600 SCF/Bbl), or usually 300 to 800 $n.l.l.C^{-1}$ (about 1,685 to 4,500 SCF/Bbl). The bulk conversion to 345° C.–(650° F.–) products will generally be below 50 percent, typically 30-40 percent.

The changes in composition which occur with operation of the hydrocracking step in the low pressure, distillate selective mode can be stated as follows: The feed, comprising a high boiling fraction of paraffins, naphthenes and aromatics, is converted to a full range hydrocracked effluent with a middle distillate of marked aromatic character and a relatively smaller amount of naphtha. The unconverted fraction is again paraffinic in character because of the aromatic-selective nature of the catalyst used in this stage. If contacted with a hydroisomerization catalyst in the second stage, the paraffins are preferentially attacked to form lower boiling iso-paraffins, mainly by reduction in molecular weight (cracking) but with a minor change in boiling point by isomerization to the lower-boiling isomers just below the cut point. Again, the middle distillate is of low pour point by reason of its iso-paraffinic content.

As indicated previously, a hydrotreating step may precede the hydrocracking to remove contaminants, principally sulfur, nitrogen and any metals present thus creating a dual hydrotreating/hydrocracking system. Hydrotreating conditions and catalysts will be conventionally chosen for this purpose. Interstage separation of inorganic sulfur and nitrogen may be carried or, as in the low pressure process described in U.S. Pat. No. 4,435,275, omitted.

In this invention there is no recycle of hydrocracker bottoms to the hydrocracker. All of the bottoms material is sent to the dewaxing or isomerization step. The bottoms from this step may then be recycled to the hydrocracker to produce a naphtha rich in aromatics and naphthenes.

When the distillate selective hydrocracking is used in the hydrocracking stage, the converted fraction will contain relatively higher proportions of paraffins in the back end, i.e., the relatively higher boiling fractions, e.g. 225° to 345° C. (about 440° to 650° F.). If the cut point for separating the portion fed to the second stage is adjusted accordingly, these paraffins will be shifted to a lower boiling point range by isomerization and hydrocracking if a hydroisomerization catalyst is used in the dewaxing stage. Thus, it may be desirable to feed the second stage with some of the converted fraction as well as the essentially unconverted fraction. The cut point may be as low as about 200° C. (about 390° F.) but will generally be at least 225° C. (about 440° F.) and in most cases will be at least 315° C. (about 600° F.), generally at about 345° C. (about 650° F.)

Dewaxing Stage

Dewaxing may occur using a hydroisomerization process, a shape-selective dewaxing process, or both in series. Both hydroisomerization and shape-selective dewaxing are discussed below.

A. Conditions and Catalyst if Hydroisomerization is Employed

1. Catalyst

This stage is essentially a hydrocracking or hydroisomerization step using a catalyst combining acidic functionality based on a large pore zeolite such as zeolite beta and hydrogenation functionality. The hydrogenation functionality may be provided either by a base metal or a noble metal. Nickel, tungsten, cobalt, molybdenum, palladium, platinum or combinations of such metals are suitable. Fluorided nickel-tungsten combinations are particularly desirable. The acidic functionality is preferably provided by zeolite beta which is a known zeolite and is described in U.S. Pat. No. RE 28,341, to which reference is made for a description of this zeolite, its preparation and properties. Hydroprocessing catalysts based on zeolite beta are described in U.S. Pat. Nos. 4,419,220, 4,501,926 and 4,518,485 and U.S. Ser. No. 379,421 and its European counterpart EU No. 94827, to which reference is made for a description of zeolite beta hydroprocessing catalysts which may be used in the dewaxing stage of the present integrated process. As described in those patents, the preferred forms of zeolite beta for use in hydroprocessing are the high silica forms, having a silica-alumina ratio of at least 30:1 (structural). Silica:alumina ratios of at least 50:1 and preferably at least 100:1 or over 100:1 or even higher, e.g. 250:1, 500:1 may be used in order to maximize the paraffin isomerization reactions at the expense of cracking. Thus, use of appropriate silica:alumina ratios in the catalyst may, together with controls of catalyst acidity, as measured typically by alpha value and control of reaction conditions may therefore be employed to vary the nature of the product, particularly the conversion and accordingly the quantity of the converted fraction from the second stage of the process.

The catalyst used in the hydroisomerization step is one which has a high selectivity for the isomerization of waxy, linear or near linear paraffins to less waxy, isoparaffinic products. Catalysts of this type are bifunctional in character, comprising a metal component on a large pore size, porous support of relatively low acidity. The acidity is maintained at a low level in order to reduce conversion to products boiling outside the lube boiling range during this stage of the operation. In general terms, the catalyst should have an alpha value below 30 prior to metals addition.

The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The hydroisomerization catalyst comprises a large pore zeolite and a metal. The large pore zeolite is supported by a porous binder. Large pore zeolites usually have at least one pore channel consisting of twelve-membered oxygen rings. Large pore zeolites usually have at least one pore channel with a major dimension greater than 7A. Zeolites beta, Y and mordenites are examples of large pore zeolites.

As indicated supra, the preferred hydroisomerization catalyst employs zeolite beta since this zeolite has been shown to possess outstanding activity for paraffin isomerization in the presence of aromatics, as disclosed in U.S. Pat. No. 4,419,220. The low acidity forms of zeolite beta may be obtained by synthesis of a highly siliceous form of the zeolite e.g. with a silica-alumina ratio above about 500:1 or, more readily, by steaming zeolites of lower silica-alumina ratio to the requisite acidity level. They may also be obtained by extraction with acids such as dicarboxylic acid, as disclosed in U.S. Pat. No. 5,200,168. U.S. Pat. No. 5,164,169 discloses the preparation of highly siliceous zeolite beta employing a chelating agent such as tertiary alkenolamines in the synthesis mixture.

The most preferred zeolites are severely steamed and possess a framework silica-alumina ratio above 200:1. Preferably the silica-alumina ratio is above 400:1 and more preferably the silica-alumina ratio is greater than 600:1.

The steaming conditions should be adjusted in order to attain the desired alpha value in the final catalyst and typically utilize atmospheres of 100 percent steam, at temperatures of from about 800° to about 1100° F. (about 427° to 595° C.). Normally, the steaming will be carried out at temperatures above 1000° F., for about 12 to 120 hours, typically about 96 hours, in order to obtain the desired reduction in acidity.

Another method is by replacement of a portion of the framework aluminum of the zeolite with another trivalent element such as boron which results in a lower intrinsic level of acid activity in the zeolite. The preferred zeolites of this type are those which contain framework boron. Boron is usually added to the zeolite framework prior to the addition of other metals. In zeolites of this type, the framework consists principally of silicon tetrahedral coordinated and interconnected with oxygen bridges. The minor amount of an element (alumina in the case of alumina-silicate zeolite beta) is also coordinated and forms part of the framework. The zeolite also contains material in the pores of the structure although these do not form part of the framework constituting the characteristic structure of the zeolite. The term "framework" boron is used here to distinguish between material in the framework of the zeolite which is evidenced by contributing ion exchange capacity to the zeolite, from material which is present in the pores and which has no effect on the total ion exchange capacity of the zeolite. Zeolite beta possesses a constraint index between 0.60 and 2.0 at temperatures between 316° C. and 399° C. although Constraint Indexes less than 1 are preferred.

Methods for preparing high silica content zeolites containing framework boron are known and are described, for example, in U.S. Pat. No. 4,269,813. A method for preparing zeolite beta containing framework boron is disclosed in U.S. Pat. No. 4,672,049. As noted there, the amount of boron contained in the zeolite may be varied by incorporating different amounts of borate ion in the zeolite forming solution e.g. by the use of varying amounts of boric acid relative to the forces of silica and alumina. Reference is made to these disclosures for a description of the methods by which these zeolites may be made.

The zeolite will be composited with a matrix material to form the finished catalyst and for this purpose conventional very low-acidity matrix materials such as alumina, silica-alumina and silica are suitable although aluminas such as alpha boehmite (alpha alumina monohydrate) may also be used, provided that they do not confer any substantial degree of acidic activity on the matrixed catalyst. The zeolite is usually composites with the matrix in amounts from 80:20 to 20:80 by weight, typically from 80:20 to 50:50 zeolite:matrix. Compositing may be done by conventional means including mulling the materials together followed by extrusion into the desired finished catalyst particles. A preferred method for extruding the zeolite with silica as a binder is disclosed in U.S. Pat. No. 4,582,815. If the catalyst is to be steamed in order to achieve the desired low acidity, it is performed after the catalyst has been formulated with the binder, as is conventional. The preferred binder for the steamed catalyst is alumina.

2. Conditions

The conditions employed in the hydroisomerization stage will depend upon the nature of the feed from the first stage and the products desired from the second stage treatment. If it is desired to maximize hydroisomerization in the second stage at the expense of hydrocracking, temperatures should be maintained at a relatively low level so as to minimize conversion, i.e. bulk conversion to lower boiling products. To achieve this, relatively low temperatures are required, typically in the range of 200° C. (about 390° F.) to 400° C. (about 750° F.) whereas if it is desired to achieve a significant bulk conversion as well as a hydroisomerization, relatively higher temperatures, typically at least 300° C. (about 570° F.) up to about 450° C. (about 850° F.) will be preferred. The balance of conversion as against isomerization will also be determined by the general severity of the reaction conditions including space velocity which is typically in the range of 0.5 to 10 and more commonly 0.5 to 2, typically about 1 $hr.^{-1}$ (LHSV).

Because the bottoms fraction from the first stage hydrocracking has a low heteroatom content, the process conditions required in the second stage are generally quite mild and may be easily accomplished at relatively low pressures, typically below about 15,000 kPa (about 2160 psig) and in most cases, below about 10,000 kPa (about 1,435 psig) or 7,000 kPa (about 1,000 psig). This enables the second stage to be carried out within the constraints of existing low pressure units, for example, catalytic hydrodesulfurization (CHD) units which typically operate at pressure below 15,000 kPa (about 2000 psig).

Total system pressure in the second stage may vary up to a maximum determined principally by equipment constraints and will generally, for this reason, not exceed 30,000 kPa (about 4350 psig) and in most cases will not exceed about 15,000 kPa (about 2,160 psig). The isomerization function of the zeolite beta based catalyst decreases at higher hydrogen pressures as the unsaturated intermediates in the reaction mechanism become more subject to interception by saturation reactions. It is therefore desirable to operate the isomerization at relatively low hydrogen pressures. In many cases, satisfactory results may be obtained below about 10,000 kPa (about 1,435 psig) or even below 7,000 kPa (about 1,000 $n.l.l.^{-1}$ (about 1,125 to 5,600 scf/bbl), preferably 500 to 1,000 $n.l.l.^{-1}$ (about 2,800 to 5,600 scf/bbl) are appropriate. However, the conditions chosen should be selected in accordance with other reaction parameters including the acidity of the catalyst, as described above.

B. Shape-selective Catalytic Dewaxing

1. Catalyst

The unconverted bottoms from the hydrocracking stage as previously discussed, contains quantities of the more waxy straight chain, n-paraffins. There are also higher melting non-normal paraffins present. Because these contribute to unfavorable pour points in lubricants, and because the hydrocracker bottoms will have a pour point which is above the target pour point for the product, it is necessary to remove these waxy components. To do this without removing the desirable isoparaffinic components which contribute to high V.I. in the lubricant product, a shape-selective dewaxing catalyst is employed. This catalyst removes the n-paraffins together with the waxy, slightly branched chain paraffins, while leaving the more branched chain isoparaffins in the process stream. Shape-selective catalytic dewaxing processes employ catalysts which are more highly selective for removal of n-paraffins and slightly branched chain paraffins than an isomerization catalyst, such as zeolite beta. Shape selective dewaxing is carried out as described in U.S. Pat. No. 4,919,788, to which reference is made for a description of this phase. The catalytic dewaxing step in the present process is carried out with a constrained, shape selective dewaxing catalyst based on a constrained intermediate pore crystallines material, such as an alumina-phosphate. A constrained intermediate crystalline material has at least one channel of 10-membered oxygen rings with any intersecting channel having 8-membered rings. ZSM-23 is the preferred zeolite for this purpose although other highly shape-selective zeolites such as ZSM-22, ZSM-48 or the synthetic ferrierite ZSM-35 may also be used, especially with lighter stocks. Silicoaluminophosphates such as SAPO-11 and SAPO-41 may be used as selective dewaxing catalysts.

The preferred catalysts for use as the shape-selective dewaxing catalysts are the relatively constrained intermediate pore size zeolites. Such preferred zeolites have a Constraint Index in the range of 1-12, as determined by the method described in U.S. Pat. No. 4,016,218. These preferred zeolites are also characterized by specific sorption properties related to their relatively constrained diffusion characteristics. These sorption characteristics are those which are set out in U.S. Pat. No. 4,810,357 for the zeolites such as zeolite ZSM-22, ZSM-23, ZSM-35 and ferrierite. These zeolites have pore openings which result in a specific combination of sorption properties, namely, (1) a ratio of sorption of n-hexane to o-xylene, on a volume percent basis, of greater than about 3, wherein sorption is determined at a $P/P_o$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MD}/k_{DMB}$ determined at a temperature of 1000° F. being in excess of about 2.

The expression, "$P/P_o$", is accorded its usual significance as described in the literature, for example, in "The Dynamical Character of Adsorption" by J. H. deBoer, 2nd Edition, Oxford University Press (1968) and is the relative pressure defined as the ratio of the partial pressure of sorbate to the vapor pressure of sorbate at the temperature of sorption. The ratio of the rate constants, $k_{3MP}/k_{DMB}$, is determined from 1st order kinetics, in the usual manner, by the following equation:

$$k=(1/T_c)1n(1/1-\epsilon)$$

where k is the rate constant for each component, $T_c$ is the contact time and $\epsilon$ is the fractional conversion of each component.

Zeolites conforming to these sorption requirements include the naturally occurring zeolite ferrierite as well as the synthetic zeolites ZSM-22, ZSM-23 and ZSM-35. These zeolites are at least partly in the acid or hydrogen form when they are used in the present process.

The preparation and properties of zeolite ZSM-22 are described in U.S. Pat. No. 4,810,357 (Chester) to which reference is made for such a description.

The synthetic zeolite ZSM-23 is described in U.S. Pat. Nos. 4,076,842 and 4,104,151 to which reference is made for a description of this zeolite, its preparation and properties.

The intermediate pore-size synthetic crystalline material designated ZSM-35 ("zeolite ZSM-35" or simply "ZSM-35"), is described in U.S. Pat. No. 4,016,245, to which reference is made for a description of this zeolite and its preparation. The synthesis of SAPO-11 is described in U.S. Pat. Nos. 4,943,424 and 4,440,871. The synthesis of SAPO-41 is described in U.S. Pat. No. 4,440,871. Other examples of the medium pore zeolites include 5 (U.S. Pat. No. 3,702,886), ZSM-11 (U.S. Pat. No. 3,709,979), ZSM-22, ZSM-23 (U.S. Pat. No. 4,076,842), ZSM-20 (U.S. Pat. No. 3,972,983), ZSM-48 (U.S. Pat. No. 4,375,573), ZSM-57, and MCM-22 (U.S. Pat. No. 4,954,325). The disclosures of these patents are herein incorporated by reference. ZSM-5 is included because it may be employed without metals, in the HZSM-5 form as discussed infra.

Ferrierite is a naturally-occurring mineral, described in the literature, see, e.g., D. W. Breck, ZEOLITE MOLECULAR SIEVES, John Wiley and Sons (1974), pages 125-127, 146, 219 and 625, to which reference is made for a description of this zeolite.

Suitable molecular sieves having a coordinated metal oxide to silica molar ratio of 20:1 to 200:1, or higher may be used. With HZSM-5, for example, it is advantageous to employ conventional aluminosilicate ZSM-5 having a silica:alumina molar ratio of about 25:1 to 70:1 although ratios above 70:1 may be used. A typical zeolite catalyst component having Bronsted acid sites may consist essentially of crystalline aluminosilicate having the structure of ZSM-5 zeolite with 5 to 95 wt. % silica, clay and/or alumina binder. It is understood that other medium pore acidic molecular sieves, such as salicylate, silica-aluminophosphate (SAPO) materials may be employed as catalysts, especially medium pore SAPO-11.

U.S. Pat. No. 4,908,120 (Bowes et al) discloses a catalytic process useful for feeds with high paraffin content or high nitrogen levels. The process employs a binder free zeolite dewaxing catalyst, preferably ZSM-5.

Medium pore zeolites are particularly useful in the process because of their regenerability, long life and stability under the extreme conditions of operation. Usually the zeolite crystals have a crystal size from about 0.01 to over 2 microns or more, with 0.02-1 micron being preferred. Although ZSM-5 (≧40 alpha) can be used in its metal-free form for selective cracking, in the case of the other medium pore acidic metallo-silicates described supra, it is necessary that they be modified with from 0.1 to 1.0 wt. % of a noble metal in order to be used as hydroisomerization dewaxing catalysts.

ZSM-5 is the only medium pore zeolite or medium pore acidic molecular sieves that is practical to use for commercial selective dewaxing without adding a noble metal. The noble metal is required with other medium pore molecular sieves in order to reduce catalyst aging rates to practical levels. The addition of a noble metal to ZSM-5, however, provides it with hydroisomerization activity that increases yields of dewaxed lube oils. It has been found that when noble metals are added to ZSM-23, ZSM-35, SAPO-11 and ZSM-5, the product yields and VI are generally higher for ZSM-23, ZSM-35 and SAPO-11 than from ZSM-5. The choice of which catalyst to use becomes one of the economics.

Catalyst size can vary widely within the inventive concept, depending upon process conditions and reactor structure. Finished catalysts having an average maximum dimension of 1 to 5 mm are preferred.

The dewaxing catalysts used in shape-selective catalytic dewaxing include a metal hydrogenation-dehydrogenation component. Although it may not be strictly necessary to promote the selective cracking reactions, the presence of this component has been found to be desirable to promote certain isomerization reactions which contribute to the synergy of the two catalyst dewaxing system. The presence of the metal component leads to product improvement, especially VI, and stability as well as helping to retard catalyst aging. The shape-selective, catalytic dewaxing is normally carried out in the presence of hydrogen under pressure. The metal will be preferably platinum or palladium. The amount of the metal component will typically be 0.1 to 10 percent by weight. Matrix materials and binders may be employed as necessary.

2. Conditions

Shape selective dewaxing using the highly constrained, highly shape-selective catalysts may be carried out in the same general manner as other catalytic dewaxing processes, such as those described supra for process employing isomerization catalysts. Conditions will therefore be of elevated temperature and pressure with hydrogen, typically at temperatures from 250° to 500° C. (about 580° F. to 930° F.), more usually 300° to 450° C. (about 570° F. to 840° F.) and in most cases not higher than about 370° C. (about 700° F.). Pressures extend up to 3,000 psi, and more usually up to 2500 psi. Space velocities extend from 0.1 to 10 $hr^{-1}$ (LHSV), more usually 0.2 to 5 $hr^{-1}$. Hydrogen circulation rates range from 500 to 1000 $n.l.l.^{-1}$, and more usually 200 to 400 $n.l.l.^{-1}$. Reference is made to U.S. Pat. No. 4,919,788 for a more extended discussion of the shape-selective catalytic dewaxing step. As indicated previously, hydrogen may be used as an interbed quench in order to provide maximum temperature control in the reactor. Pt/ZSM-23, although primarily a shape selective catalyst, adds incremental isomerization capability.

The degree of conversion to lower boiling species and the choice of dewaxing catalyst in the shape-selective dewaxing stage will vary according to the extent of dewaxing desired at this point, i.e. on the difference between the target pour point and the pour point of the unconverted bottoms from the hydrocracking stage. It will also depend upon the selectivity of the shape-selective catalyst which is used. At lower product pour points, and with relatively less selective dewaxing catalysts, higher conversions and correspondingly higher hydrogen consumptions will be encountered. In general terms conversion to products boiling outside the lube range, e.g. 315° C.–, more typically 343° C.–, will be at least 5 weight percent, and in most cases at least 10 weight percent, with conversions of up to about 30 weight percent being necessary only to achieve the lowest pour points with catalysts of the required selectivity. Boiling range conversion on a 650° F.+ (343° C.+) basis will usually be in the range of 10-25 weight percent.

After the pour point of the product has been reduced to the desired value by selective dewaxing, may be subjected to treatments such as hydrotreating, in order to remove color bodies and produce a lube product of the desired characteristics. Fractionation may be employed to remove light ends and to meet volatility specifications.

Isomerization catalysts such as zeolite beta are effective for selectively converting bulky wax molecules when operated to convert 40% to 90%, more preferably 50% to 80%, of the wax in the feed to the isomerization process. The shape-selective intermediate pore size catalysts are, by contrast, more effective at removing the waxes in the front end (low boiling components) of the feed thereby reducing cloud point and pour point in products such as lubes. Intermediate pore size molecular sieves such as Pt/ZSM-23 possesses incremental isomerization capabilities in addition to shape-selective dewaxing capabilities.

DESCRIPTION OF THE PREFERRED EMBODIMENTS

FIG. 1 illustrates one of the preferred embodiments of this invention. The feed (line 1(*a*)), which may be any hydrocarbon feedstock boiling above 343° C. (see discussion supra) is combined with bottoms material from the dewaxing process (line 1(*b*)) forming line 1(*c*) and hydrogen from line 2 before being introduced to hydrocracker 1. Hydrocracker 1 includes a catalytic hydrocracking zone. This could also encompass hydrotreating alone or a combination hydrotreating/hydrocracking zone. Fixed bed reactors are preferred. Conditions are effective to convert in a single pass at least 20% of the feed to materials boiling below the initial boiling point of said feed. The pressure at which the hydrocracking step of FIG. 1 operates is substantially higher than the pressure employed in the dewaxing step.

The effluent from the hydrocracker 1 including excess hydrogen passes to the high temperature separator 3 via line 4 wherein hydrocrackate is separated from hydrogen contaminated with hydrogen sulfide and ammonia. In an alternate embodiment not illustrated, the effluent from hydrocracker 1 is cascaded directly to the dewaxing stage, without any interstage separation. Desulfurization and denitrogenation frequently accompany the aromatics saturation occurring in the hydrocracker. The contaminated hydrogen is passed from the high temperature separator 5 to low temperature separator 6 where a substantial portion of the contaminated gases are removed via line 7 and eventually passed to off gas. The hydrogen is passed to compressor 8, then returned to the hydrocracker inlet via line 2. The hydrocrackate, with some gases removed, moves via line 9 to steam stripper 10 for further removal of gases and light ends, which pass via line 11 to off gas. The hydrocrackate passes through line 12 to the flash zone of fractionation unit 13, in which a baffle 14 is installed. The baffle is intended to separate hydrocracker bottoms from dewaxer bottoms. The hydrocrackate is subjected to atmospheric distillation to remove lighter boiling components such as naphtha(lines 13(*a*) and 13(*b*)) and middle distillate boiling products (lines 13(*c*) and 13(*d*)).

The hydrocracker bottoms pass via line 15 to the inlet of the isomerization/dewaxing zone 16, where it is combined with hydrogen from line 17. The isomerization/dewaxing zone is a fixed bed reactor which contains a large pore zeolite dewaxing catalyst such as zeolite beta or a shape-selective catalyst(see discussion supra concerning dewaxing catalysts). The dewaxer effluent is passed to high temperature separator 18 for the removal of hydrogen, and light gases, as previously described. The gaseous stream is passed via line 19 to the low temperature separator 20. These separators operate at temperatures between 100° F. and 200° F., where contaminant gases are passed to off gas via line 21. Contaminant gases from the hydrocracker section, line 11 are combined with these gases in line 22. Hydrogen is passed via line 23 to compressor 24, where its pressure is raised before it is returned to the hydrocracker via line 25. Effluent from the high temperature separator 18 enters stream stripper 26 via line 27 for further removal, via line 28, of gases and light ends, which combine with those of line 22 prior to entry into flash drum 29, where some materials boiling in the $C_3$- range are removed by line 30 to off gas. The rest of the flash drum effluent passes to the butanizer 31 by means of line 32. In butanizer 31, $C_4^-$ material, suitable for LPG, is removed via lines 31(*a*) and 31(*b*), and the remainder of the flash drum effluent passes to the flash portion of fractionation unit 13 by means of line 33. The dewaxed effluent, with light ends removed, moves through line 34 to the bottom portion of the fractionation unit 13 for atmospheric distillation, being separated from the hydrocrackate bottoms by baffle 14. Materials boiling in the naphtha and middle distillate ranges are removed. The remaining unconverted dewaxed material is suitable for use as lubricant base stock and may be removed via line 35 for this purpose. Some or all or the unconverted dewaxed material may be recycled by means of line 36 to be combined with fresh feed prior to entry to the hydrocracker.

Figure 2:
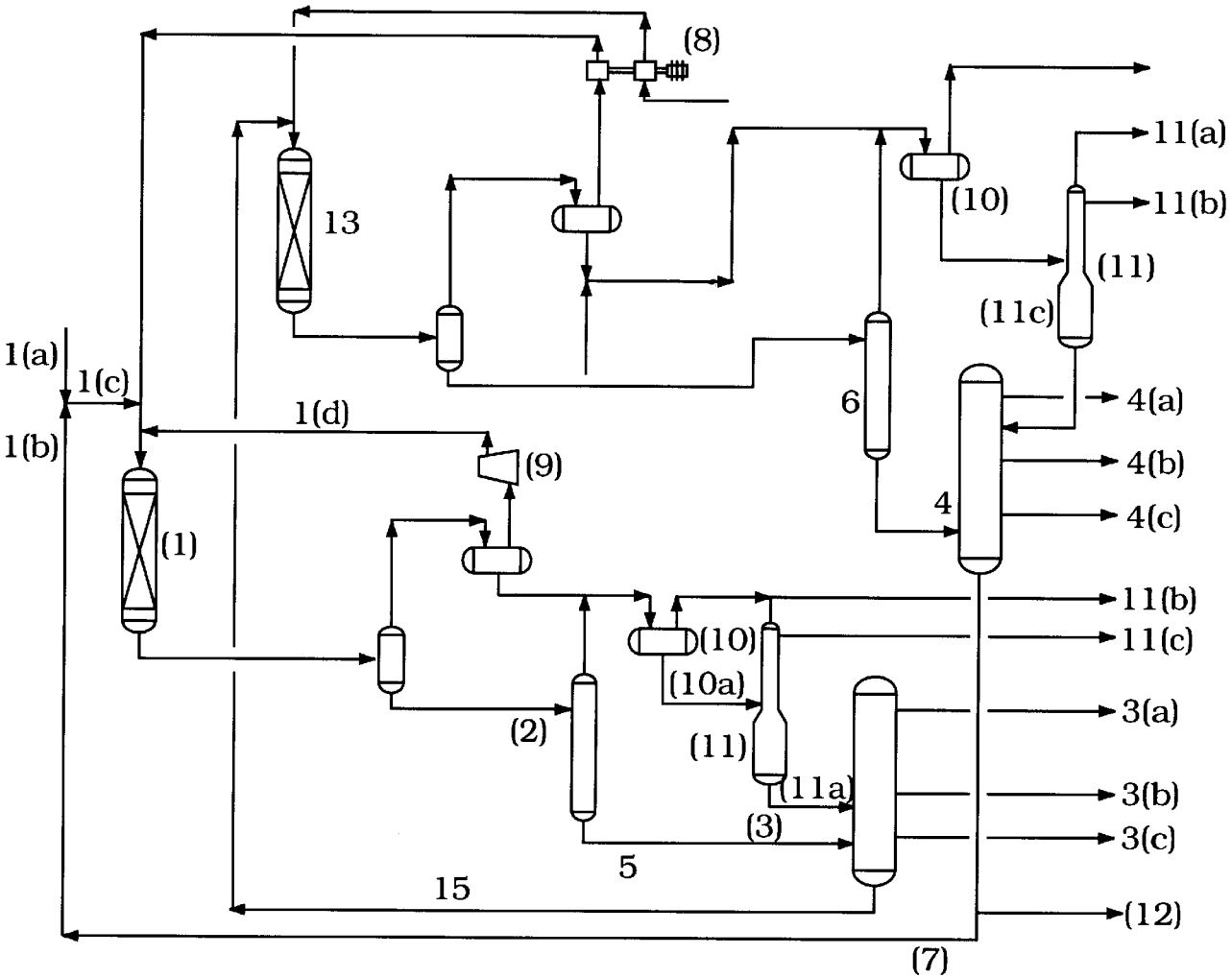
In FIG. 2, the hydrocracked effluent and the dewaxed effluent are processed separately by the use of separate fractionation units and debutanizers. This is desirable if dewaxing or isomerization is to be performed at high pressure.

The feed (line 1(*a*)), which may be any hydrocarbon feedstock boiling above 343°0 C. (see discussion supra) is combined with bottoms material from the dewaxing process (line 1(*b*)) forming line 1(*c*) and hydrogen from line 1(*d*) before being introduced to hydrocracker 1. FIG. 2 provides a slightly different embodiment. The design in FIG. 2 is intended to maintain complete segregation of all products from the two reaction stages. In some cases it may be beneficial to conduct the dewaxing/isomerization reactions at high pressure. Instead of a single fractionation unit, two separate fractionation units are employed, one following stripper 2 and the other following stripper 6. Gases stripped from hydrocracker effluent in stripper 2 proceed to the flash drum 10, where heavier material is removed via line 10(*a*) from the flash drum and passed to the butanizer 11. In butanizer 11, $C_4^-$ material, suitable for LPG, is removed via lines 11(*a*) and 11(*b*), and the remainder of the flash drum effluent passes to the flash portion of fractionation unit 3 by means of line 11(*c*). Stripped hydrocracker effluent enters fractionation unit 3 via line 5. Lighter products are removed by atmospheric distillation. (Lines 3(*a*)-3(*c*) represent lighter products. Naphtha products are represented by line 3(*a*), middle distillates are represented by line 3(*b*), and lubricant products are represented by line 3(*c*).[and the] Hydrocracker bottoms move from the bottom of the fractionation unit via line 15 to the isomerization/dewaxer zone 13. Stripped and dewaxed material passes from stripper 6 to fractionation unit 4, where stream 4(*a*) represents naphtha products, and streams 4(*b*) and 4(*c*) represent middle distillate products. As in FIG. 1, the unconverted bottoms material may be passed to lube base stock via line 12 or recycled to the hydrocracker via line 7.

Figure 3:
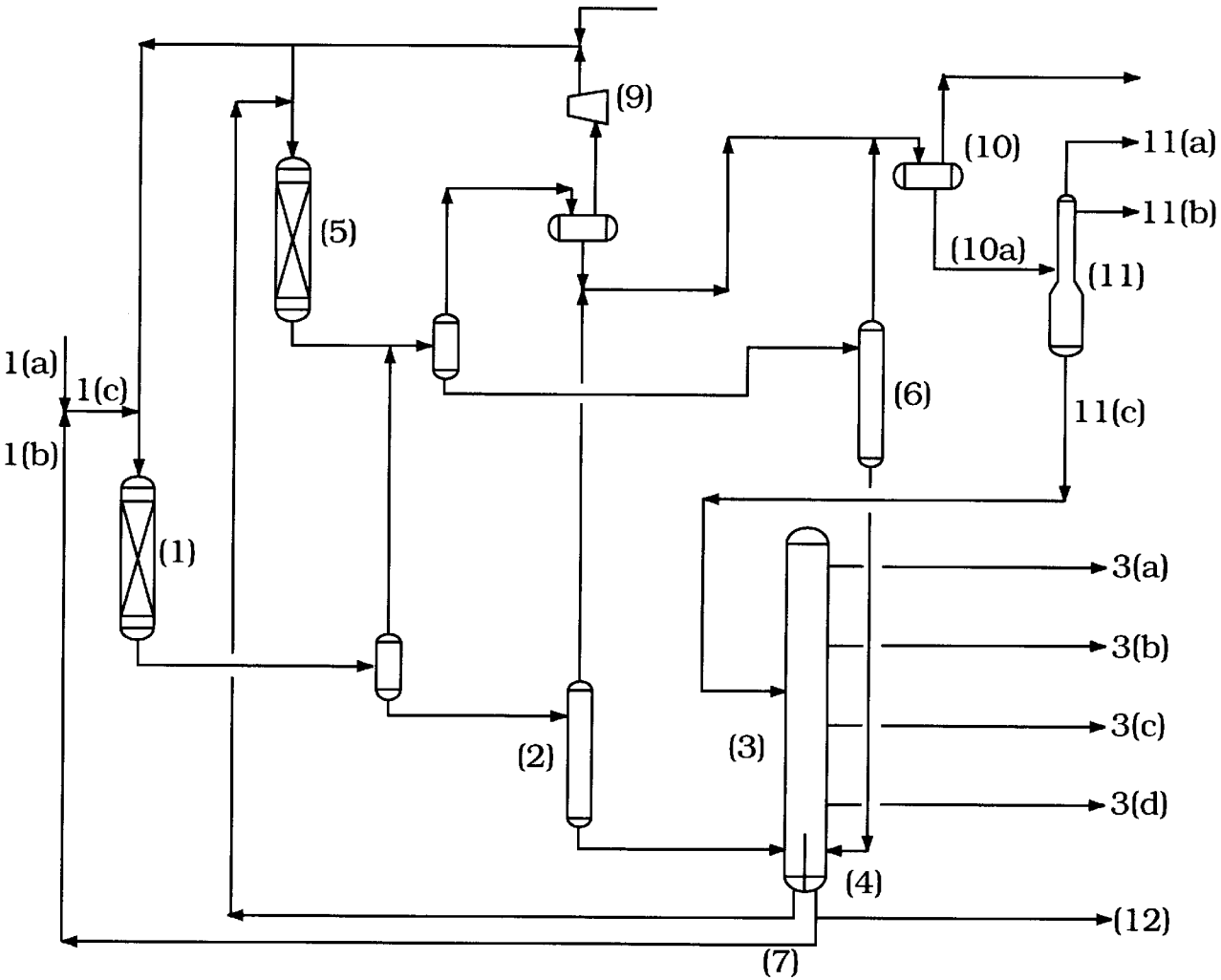

FIG. 3 is an integrated process design which resembles FIG. 1, except that a make-up hydrogen compressor is used to supply once-through hydrogen flow between compression stages. The feed (line 1(*a*)), which may be any hydrocarbon feedstock boiling above 343° C. (see discussion supra) is combined with bottoms material from the dewaxing process (line 1(*b*)) forming line 1(*c*) and hydrogen from line 1(*d*) before being introduced to hydrocracker 1. As illustrated in FIG. 1, the hydrocrackate is subjected to atmospheric distillation to remove lighter boiling components such as naphtha(lines 3(*a*) and 3(*b*)) and middle distillate boiling products (lines 3(*c*) and 3(*d*)).

Gases stripped from hydrocracker effluent in stripper 6 proceed to the flash drum 10, where heavier material is removed via line 10(*a*) from the flash drum and passed to the butanizer 11. In butanizer 11, $C_4^-$ material, suitable for LPG, is removed via lines 11(*a*) and 11(*b*), and the remainder of the flash drum effluent passes to the flash portion of fractionation unit 3 by means of line 11(*c*).

What is claimed is:

1. An integrated hydroprocessing process for upgrading a gas oil hydrocarbon feedstock having a paraffin content of no more than 30 wt %, an initial boiling point of at least 3150C. into a naphtha product, a distillate product boiling above the naphtha range and a lubricant product, the process comprising:

(a) hydrocracking the hydrocarbon feedstock over an aromatic-selective hydrocracking catalyst which is selected from the group consisting of zeolite X, zeolite Y, ZSM-3, ZSM-18 ZSM-20, MCM-22, mordenite and zeolite beta, the catalyst having an acidic functionality and hydrogenation-dehydrogenation functionality, under hydrocracking conditions at a hydrogen partial pressure of at least 7000 kPa and from 15 to 80 wt % conversion to lower boiling products, to form a naphtha product, a distillate product, and a bottoms fraction enriched in paraffinic components;

(b) separating the naphtha product, the distillate product and the bottoms fraction;

(c) hydroprocessing the separated bottoms fraction over at least one hydroprocessing catalyst, wherein the hydroprocessing catalyst comprises a zeolite possessing a framework silica:alumina ratio above 200:1, which performs dewaxing;

(d) separating the effluent from step (c) into a bottoms fraction and a fraction boiling below the bottoms range, wherein at least a portion of the bottoms fraction is recycled to step (a) and the lower boiling fraction is separated into naphtha and distillate products;

(e) the bottoms fraction not recycled to step (a) is used as a lubricant basestock.

2. The process of step claim 1, step(a), whereby the hydrocracking catalyst is in an enhanced stability form and is selected from the group consisting of REX, REY, dealuminized Y, dealuminized X and dealuminized mordenite having a framework silica:alumina molar ratio of at least 50:1.

3. The process of claim 2, whereby the hydrocracking catalyst is dealuminzed USY.

4. The process of claim 1, step (c), wherein the hydroprocessing catalyst performs dewaxing by hydroisomerization or by shape-selective means.

5. The process of claim 1, step (c), wherein dewaxing is performed over a hydroisomerization catalyst and shape selective catalyst in series.

6. The process of claim 1, step (c), wherein the hydroprocessing catalyst is a low acidity large pore zeolite hydroisomerization catalyst, the catalysts having an alpha value of not more than 30 and containing a metal hydrogenation component.

7. The process of claim 6, wherein the hydroisomerization catalyst comprises zeolite beta.

8. The process of claim 6, wherein the hydroisomerization catalyst possesses a silica:alumina molar ratio greater than 200:1.

9. The process of claim 1, step (c), wherein the hydroprocessing catalyst comprises a constrained intermediate pore crystalline material having a metal hydrogenation-dehydrogenation component for shape-selective dewaxing.

10. The process of claim 9, wherein the constrained intermediate pore crystalline material is ZSM-23.

11. The process of claim 1, step (c), wherein the hydroprocessing catalyst comprises HZSM-5 for shape-selective dewaxing.

12. The process of claim 1, step (b), wherein the effluents of steps (a) and (c) are separated into products by atmospheric distillation in a single fractionation unit, in which bottoms products from step (b) are maintained separately from the bottoms products of step (d).

13. The process of claim 1, step (b), wherein the effluent of step (a) is separated into products by atmospheric distillation in a separate fraction unit from the effluent of step (c).

14. The process of claim 1, in which the hydrocarbon feedstock is hydrotreated with a conventional hydrotreating catalyst prior to the hydrocracking step in order to remove contaminants.

15. An integrated hydroprocessing process for upgrading a gas oil hydrocarbon feedstock having a paraffin content of no more than 30 wt %, an initial boiling point of at least 3150C. into a naphtha product, a distillate product boiling above the naphtha range and a lubricant product, the process comprising:

(a) hydrocracking the hydrocarbon feedstock over an aromatic-selective hydrocracking catalyst selected from the group consisting of zeolite X, zeolite Y, ZSM-3, ZSM-18, ZSM-20, MCM-22, mordenite and zeolite beta, the catalyst having an acidic functionality and hydrogenation-dehydrogenation functionality, under hydrocracking conditions at a hydrogen partial pressure of at least 7000 kPa and from 15 to 80 wt % conversion to lower boiling products, to form an effluent comprising a naphtha product, a distillate product, and a bottoms fraction enriched in paraffinic components;

(b) hydroprocessing the effluent from the hydrocracking step over at least one hydroprocessing catalyst which performs dewaxing;

(c) separating the effluent from step (b) into a bottoms fraction and a fraction boiling below the bottoms range, wherein at least a portion of the bottoms fraction is recycled to step (a) and the lower boiling fraction is separated into naphtha and distillate products;

(d) the bottoms fraction not recycled to step (a) is used as a lubricant basestock.

16. An integrated hydroprocessing process for upgrading a gas oil hydrocarbon feedstock having a paraffin content of no more than 30 wt %, an initial boiling point of at least 315° C. into a naphtha product, a distillate product boiling above the naphtha range and a lubricant product, the process comprising:

(a) hydrocracking the hydrocarbon feedstock over an aromatic-selective hydrocracking catalyst which is selected from the group consisting of zeolite X, zeolite Y, ZSM-3, ZSM-18, ZSM-20, MCM-22, mordenite and zeolite beta, the catalyst having an acidic functionality and hydrogenation-dehydrogenation functionality, under hydrocracking conditions at a hydrogen partial pressure of at least 7000 kPa and from 15 to 80 wt % conversion to lower boiling products, to form a naphtha product, a distillate product, and a bottoms fraction enriched in paraffinic components;

(b) separating the naphtha product, the distillate product and the bottoms product in an atmospheric distillation unit:

(c) hydroprocessing the separated bottoms fraction over at least one hydroprocessing catalyst which performs dewaxing;

(d) recycling the effluent from step (c) to the atmospheric distillation unit of step (b), wherein the bottoms fraction of step (b) is maintained separately from the bottoms fraction of step (c);

(c) separating the effluent from step (c) into a bottoms fraction and a fraction boiling below the bottoms range, wherein at least a portion of the bottoms fraction is recycled to step (a) and the lower boiling fraction is separated into naphtha and distillate products;

(d) the bottoms fraction not recycled to step (a) is used as a lubricant basestock.

* * * * *